US006467256B2

(12) United States Patent
Hashimoto

(10) Patent No.: US 6,467,256 B2
(45) Date of Patent: Oct. 22, 2002

(54) EXHAUST EMISSION CONTROL SYSTEM FOR INTERNAL COMBUSTION ENGINE

(75) Inventor: Akira Hashimoto, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/910,052

(22) Filed: Jul. 23, 2001

(65) Prior Publication Data

US 2002/0007627 A1 Jan. 24, 2002

(30) Foreign Application Priority Data

Jul. 21, 2000 (JP) ..... 2000-219955

(51) Int. Cl.[7] ..... F01N 3/00
(52) U.S. Cl. ..... 60/277; 60/301
(58) Field of Search ..... 60/274, 277, 299, 60/301

(56) References Cited

U.S. PATENT DOCUMENTS 6,244,046 B1 * 6/2001 Yamashita ..... 60/276
6,263,667 B1 * 7/2001 Sawada et al. ..... 122/443
6,330,796 B1 * 12/2001 Nishimura et al. ..... 123/295
6,338,243 B1 * 1/2002 Takaoka et al. ..... 60/276
6,345,499 B1 * 2/2002 Nishimura et al. ..... 123/295
6,357,224 B1 * 3/2002 Kawamoto et al. ..... 60/277

FOREIGN PATENT DOCUMENTS

JP 10-299460 11/1998

* cited by examiner

*Primary Examiner*—Thomas Denion
*Assistant Examiner*—Diem Tran
(74) *Attorney, Agent, or Firm*—Arent Fox Kintner Plotkin & Kahn, PLLC

(57) ABSTRACT

An exhaust emission control system for an internal combustion engine, having a catalyst provided in an exhaust system of the engine for purifying exhaust gases, and a NOx removing device provided downstream of the catalyst for absorbing NOx contained in the exhaust gases in an exhaust lean condition, is disclosed. A first oxygen concentration sensor is provided between the catalyst and the NOx removing device, and a second oxygen concentration sensor is provided downstream of the NOx removing device. A first time period, which is an elapsed time period from the time the output from the first oxygen concentration sensor has reached a first reference value after switching the air-fuel ratio from the lean region to the rich region, is measured. A second time period, which is an elapsed time period from the time the output from the first oxygen concentration sensor has reached a second reference value corresponding to a richer air-fuel ratio with respect to the first reference value, is measured. It is determined according to the first and second time periods and the output from the second oxygen concentration sensor that the NOx removing devices is normal or deteriorated.

20 Claims, 7 Drawing Sheets

NORMAL NOx REMOVING DEVICE

DETERIORATED NOx REMOVING DEVICE

EXHAUST EMISSION CONTROL SYSTEM FOR INTERNAL COMBUSTION ENGINE

BACKGROUND OF THE INVENTION

The present invention relates to an exhaust emission control system for an internal combustion engine, and more particularly to an exhaust emission control system including a NOx (nitrogen oxide) removing device for removing NOx and having a function of determining deterioration of the NOx removing device.

When the air-fuel ratio of an air-fuel mixture to be supplied to an internal combustion engine is set in a lean region with respect to a stoichiometric ratio, the emission amount of NOx tends to be increased. To cope with this, a known technique for exhaust emission control includes providing a NOx removing device containing a NOx absorbent for absorbing NOx in an exhaust system of the engine. The NOx absorbent has such a characteristic that when the air-fuel ratio is set in a lean region with respect to the stoichiometric ratio and the oxygen concentration in exhaust gases is therefore relatively high (the amount of NOx is large) (this condition will be hereinafter referred to as "exhaust lean condition"), the NOx absorbent absorbs NOx. When the air-fuel ratio is set in a rich region with respect to the stoichiometric ratio and the oxygen concentration in exhaust gases is therefore relatively low (this condition will be hereinafter referred to as "exhaust rich condition"), the NOx absorbent discharges the absorbed NOx. The NOx removing device containing this NOx absorbent is configured so that NOx discharged from the NOx absorbent in the exhaust rich condition is reduced by HC and CO and then exhausted as nitrogen gas, while HC and CO are oxidized by NOx and then exhausted as water vapor and carbon dioxide.

There is naturally a limit to the amount of NOx that can be absorbed by the NOx absorbent, and this limit tends to decrease with deterioration of the NOx absorbent. A technique of determining a degree of deterioration of the NOx absorbent is known in the art (Japanese Patent Laid-open No. Hei 10-299460). In this technique, two oxygen concentration sensors are arranged upstream and downstream of the NOx removing device, and air-fuel ratio enrichment for discharging the NOx absorbed by the NOx absorbent is carried out. Then, the degree of deterioration of the NOx absorbent is determined according to a delay time period from the time when an output value from the upstream oxygen concentration sensor has changed to a value indicative of a rich air-fuel ratio to the time when an output value from the downstream oxygen concentration sensor has changed to a value indicative of a rich air-fuel ratio.

However, in the case that a catalyst for purifying exhaust gases is provided upstream of the upstream oxygen concentration sensor, the transient characteristic of the output from the upstream oxygen concentration sensor upon enrichment of the air-fuel ratio changes according to the degree of deterioration of the catalyst (in other words, the transient characteristic of an oxygen concentration on the downstream side of the catalyst changes). Accordingly, when the above-mentioned conventional technique is applied as it is, the accuracy of the deterioration determination is reduced.

That is, as the catalyst upstream of the upstream oxygen concentration sensor becomes older (the degree of deterioration of the catalyst becomes larger), the slope of a change in the output from the upstream oxygen concentration sensor in the case of executing the air-fuel ratio enrichment becomes larger. Further, there is a tendency that as the upstream catalyst becomes older (the degree of deterioration of the catalyst becomes larger), the delay time period from the time the output from the upstream oxygen concentration sensor has exceeded a predetermined threshold to the time the output from the downstream oxygen concentration sensor exceeds the predetermined threshold, becomes shorter. Accordingly, the delay time period in the case that a new catalyst is provided upstream of a deteriorated NOx removing device becomes substantially equal to the delay time period in the case that an old catalyst is provided upstream of a normal NOx removing device, so that there is a case that it is difficult to distinguish between the deteriorated NOx removing device and the normal NOx removing device.

SUMMARY OF THE INVENTION

It is accordingly an object of the present invention to provide an exhaust emission control system which can accurately determine the deterioration of a NOx removing device irrespective of the degree of deterioration of a catalyst provided upstream of the NOx removing device.

In accordance with the present invention, there is provided an exhaust emission control system for an internal combustion engine, having a catalyst provided in an exhaust system of the engine for purifying exhaust gases, and a NOx removing device provided downstream of the catalyst for absorbing NOx contained in the exhaust gases in an exhaust lean condition. The exhaust emission control system comprises a first oxygen concentration sensor provided between the catalyst and the NOx removing device for detecting an oxygen concentration in the exhaust gases, a second oxygen concentration sensor provided downstream of the NOx removing device for detecting an oxygen concentration in the exhaust gases, an air-fuel ratio switching module for switching an air-fuel ratio of an air-fuel mixture to be supplied to the engine from a lean region to a rich region with respect to a stoichiometric ratio, a first measuring module for measuring a first time period as an elapsed time period from the time the output from the first oxygen concentration sensor has reached a first reference value after switching the air-fuel ratio from the lean region to the rich region, a second measuring module for measuring a second time period as an elapsed time period from the time the output from the first oxygen concentration sensor has reached a second reference value corresponding to a richer air-fuel ratio with respect to the first reference value and a deterioration determining module for determining whether the NOx removing device is normal or deteriorated according to the first and second time periods and the output from the second oxygen concentration sensor.

With this configuration, the air-fuel ratio is switched from the lean region to the rich region by the air-fuel ratio switching module. Thereafter, the first time period is measured by the first measuring module. Further, the second time period is measured by the second measuring module. Then, the deterioration of the NOx removing device is determined according to the first and second time periods measured above and the output from the second oxygen concentration sensor. The relation between the second time period and the output from the second oxygen concentration sensor is less susceptible to the degree of deterioration of the catalyst provided upstream of the NOx removing device, and the relation between the first time period and the output from the second oxygen concentration sensor is less susceptible to variations in response characteristics of the oxygen concentration sensors. Accordingly, by taking the first and second time periods into consideration, accurate determination of deterioration can be performed.

The deterioration determining module determines that the NOx removing device is normal if the first time period is greater than or equal to an OK determination threshold at the time the output from the second oxygen concentration sensor has reached the first reference value.

The deterioration determining module determines that the NOx removing device is deteriorated if the first time period is less than an NG determination threshold at the time the output from the second oxygen concentration sensor has reached the first reference value.

The deterioration determining module determines that the NOx removing device is normal if the first time period is greater than or equal to an NG determination threshold and less than an OK determination threshold, which is greater than the NG determination threshold at the time the output from the second oxygen concentration sensor has reached the first reference value, and if the second time period is greater than or equal to a predetermined determination threshold at the time the output from the second oxygen concentration sensor has reached the second reference value.

The deterioration determining module determines that the NOx removing device is deteriorated if the first time period is greater than or equal to an NG determination threshold and less than an OK determination threshold, which is greater than the NG determination threshold at the time the output from the second oxygen concentration sensor has reached the first reference value, and if the second time period is less than a predetermined determination threshold at the time the output from the second oxygen concentration sensor has reached the second reference value.

The deterioration determining module determines that the NOx removing device is deteriorated if the output from the second oxygen concentration sensor is greater than the first reference value at the time the first time period has reached an NG determination threshold.

The deterioration determining module determines that the NOx removing device is normal if the output from the second oxygen concentration sensor is less than or equal to the first reference value at the time the first time period has reached an OK determination threshold.

The deterioration determining module determines that the NOx removing device is normal if the output from the second oxygen concentration sensor is greater than the first reference value at the time the first time period has reached an OK determination threshold, and if the output from the second oxygen concentration sensor is less than or equal to the second reference value at the time the second time period has reached a predetermined determination threshold.

The deterioration determining module determines that the NOx removing device is deteriorated if the output from the second oxygen concentration sensor is greater than the first reference value at the time the first time period has reached an OK determination threshold, and if the output from the second oxygen concentration sensor is greater than the second reference value at the time the second time period has reached a predetermined determination threshold.

The present invention also provides an exhaust emission control system for an internal combustion engine, having a catalyst provided in an exhaust system of the engine for purifying exhaust gases, and a NOx removing device provided downstream of the catalyst for absorbing NOx contained in the exhaust gases in an exhaust lean condition. The exhaust emission control system comprises a first oxygen concentration sensor provided between the catalyst and the NOx removing device for detecting an oxygen concentration in the exhaust gases, a second oxygen concentration sensor provided downstream of the NOx removing device for detecting an oxygen concentration in the exhaust gases, an air-fuel ratio switching module for switching the air-fuel ratio of an air-fuel mixture to be supplied to the engine from a lean region to a rich region with respect to a stoichiometric ratio, a first reducing-component amount calculating module for calculating a first reducing-component amount which is an amount of reducing components flowing into the NOx removing device from the time the output from the first oxygen concentration sensor has reached a first reference value after switching the air-fuel ratio from the lean region to the rich region, a second reducing-component amount calculating module for calculating a second reducing-component amount which is an amount of reducing components flowing into the NOx removing device from the time the output from the first oxygen concentration sensor has reached a second reference value corresponding to a richer air-fuel ratio with respect to the first reference value, and a deterioration determining module for determining whether the NOx removing device is normal or deteriorated according to the first and second reducing-component amounts and the output from the second oxygen concentration sensor.

The deterioration determining module determines that the NOx removing device is normal if the first reducing-component amount is greater than or equal to an OK determination threshold at the time the output from the second oxygen concentration sensor has reached the first reference value.

The deterioration determining module determines that the NOx removing device is deteriorated if the first reducing-component amount is less than an NG determination threshold at the time the output from the second oxygen concentration sensor has reached the first reference value.

The deterioration determining module determines that the NOx removing device is normal if the first reducing-component amount is greater than or equal to an NG determination threshold and less than an OK determination threshold, which is greater than the NG determination threshold at the time the output from the second oxygen concentration sensor has reached the first reference value, and if the second reducing-component amount is greater than or equal to a predetermined determination threshold at the time the output from the second oxygen concentration sensor has reached the second reference value.

The deterioration determining module determines that the NOx removing device is deteriorated if the first reducing-component amount is greater than or equal to an NG determination threshold and less than an OK determination threshold, which is greater than the NG determination threshold at the time the output from the second oxygen concentration sensor has reached the first reference value, and if the second reducing-component amount is less than a predetermined determination threshold at the time the output from the second oxygen concentration sensor has reached the second reference value.

The deterioration determining module determines that the NOx removing device is deteriorated if the output from the second oxygen concentration sensor is greater than the first reference value at the time the first reducing-component amount has reached an NG determination threshold.

The deterioration determining module determines that the NOx removing device is normal if the output from the second oxygen concentration sensor is less than or equal to the first reference value at the time the first reducing-component amount has reached an OK determination threshold.

The deterioration determining module determines that the NOx removing device is normal if the output from the second oxygen concentration sensor is greater than the first reference value at the time the first reducing-component amount has reached an OK determination threshold, and if the output from the second oxygen concentration sensor is less than or equal to the second reference value at the time the second reducing-component amount has reached a predetermined determination threshold.

The deterioration determining module determines that the NOx removing device is deteriorated if the output from the second oxygen concentration sensor is greater than the first reference value at the time the first reducing-component amount has reached an OK determination threshold, and if the output from the second oxygen concentration sensor is greater than the second reference value at the time the second reducing-component amount has reached a predetermined determination threshold.

DETAILED DESCRIPTION OF THE PREFERRED EMBODIMENTS

The currently preferred embodiments of the present invention will now be described with reference to the drawings.

Figure 1:
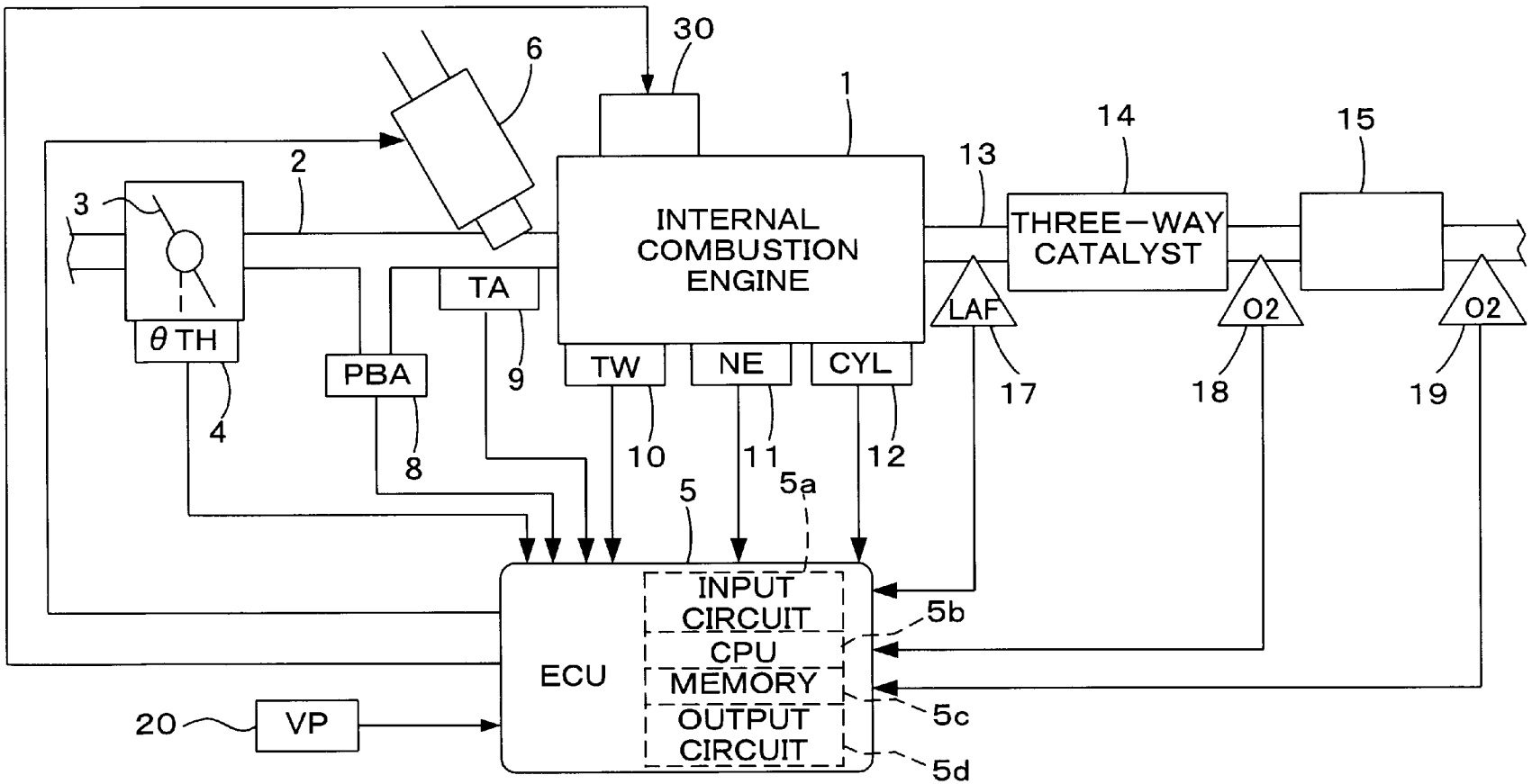
FIG. 1 is a schematic diagram showing the configuration of an internal combustion engine and an exhaust emission control system therefor according to a preferred embodiment of the present invention.

Referring to FIG. 1, there is schematically shown a general configuration of an internal combustion engine (which will be hereinafter referred to as "engine") and a control system therefor, including an exhaust emission control system according to a preferred embodiment of the present invention. The engine 1 may be a four-cylinder engine. Engine 1 has an intake pipe 2 provided with a throttle valve 3. A throttle valve opening angle (θ TH) sensor 4 is connected to the throttle valve 3. The sensor 4 outputs an electrical signal corresponding to an opening angle of the throttle valve 3 and supplies the electrical signal to an electronic control unit (which will be hereinafter referred to as "ECU") 5 for controlling engine 1.

Fuel injection valves 6, only one of which is shown, are inserted into the intake pipe 2 at locations intermediate between the cylinder block of the engine 1 and the throttle valve 3 and slightly upstream of the respective intake valves (not shown). These fuel injection valves 6 are connected to a fuel pump (not shown), and electrically connected to the ECU 5. A valve opening period of each fuel injection valve 6 is controlled by a signal output from the ECU 5.

An absolute intake pressure (PBA) sensor 8 is provided immediately downstream of the throttle valve 3. An absolute pressure signal converted to an electrical signal by the absolute intake pressure sensor 8, is supplied to the ECU 5. An intake air temperature (TA) sensor 9 is provided downstream of the absolute intake pressure sensor 8 to detect an intake air temperature TA. An electrical signal corresponding to the detected intake air temperature TA, is outputted from the sensor 9 and supplied to the ECU 5.

An engine coolant temperature (TW) sensor 10 such as a thermistor is mounted on the body of the engine 1 to detect an engine coolant temperature (cooling water temperature) TW. A temperature signal corresponding to the detected engine coolant temperature TW is output from the sensor 10 and supplied to the ECU 5.

An engine rotational speed (NE) sensor 11 and a cylinder discrimination (CYL) sensor 12 are mounted in facing relation to a camshaft or a crankshaft (both not shown) of the engine 1. The engine rotational speed sensor 11 outputs a TDC signal pulse at a crank angle position located at a predetermined crank angle before the top dead center (TDC) corresponding to the start of an intake stroke of each cylinder of the engine 1 (at every 180° crank angle in the case of a four-cylinder engine). The cylinder discrimination sensor 12 outputs a cylinder discrimination signal pulse at a predetermined crank angle position for a specific cylinder of engine 1. These signal pulses output from the sensors 11 and 12 are supplied to the ECU 5.

An exhaust pipe 13 of the engine 1 is provided with a three-way catalyst 14 and a NOx removing device 15 as NOx removing means arranged downstream of the three-way catalyst 14.

The three-way catalyst 14 has an oxygen storing capacity, and has the function of storing some of the oxygen contained in the exhaust gases in the exhaust lean condition where the air-fuel ratio of an air-fuel mixture to be supplied to the engine 1 is set in a lean region with respect to the stoichiometric ratio and the oxygen concentration in the exhaust gases is therefore relatively high. The three-way catalyst 14 also has the function of oxidizing HC and CO contained in the exhaust gases by using the stored oxygen in the exhaust rich condition where the air-fuel ratio of the air-fuel mixture to be supplied to the engine 1 is set in a rich region with respect to the stoichiometric ratio and the oxygen concentration in the exhaust gases is therefore low with a large proportion of HC and CO components.

The NOx removing device 15 includes a NOx absorbent for absorbing NOx and a catalyst for accelerating oxidation and reduction. The NOx removing device 15 absorbs NOx in the exhaust lean condition where the air-fuel ratio of the air-fuel mixture to be supplied to the engine 1 is set in a lean region with respect to the stoichiometric ratio. The NOx removing device 15 discharges the absorbed NOx in the exhaust rich condition where the air-fuel ratio of the air-fuel mixture supplied to engine 1 is in the vicinity of the stoichiometric ratio or in a rich region with respect to the stoichiometric ratio, thereby reducing the discharged NOx into nitrogen gas by HC and CO and oxidizing the HC and CO into water vapor and carbon dioxide.

When the amount of NOx absorbed by the NOx absorbent reaches the limit of its NOx absorbing capacity, i.e., the maximum NOx absorbing amount, the NOx absorbent cannot absorb any more NOx. Accordingly, to discharge the absorbed NOx and reduce it, the air-fuel ratio is enriched, that is, reduction enrichment of the air-fuel ratio is performed.

A proportional type air-fuel ratio sensor (which will be hereinafter referred to as "LAF sensor") 17 is mounted on the exhaust pipe 13 at a position upstream of the three-way catalyst 14. The LAF sensor 17 outputs an electrical signal substantially proportional to the oxygen concentration (air-fuel ratio) in the exhaust gases, and supplies the electrical signal to the ECU 5.

A binary type oxygen concentration sensor (which will be hereinafter referred to as "O2 sensor") 18 is mounted on the exhaust pipe 13 at a position between the three-way catalyst 14 and the NOx removing device 15, and an O2 sensor 19 is mounted on the exhaust pipe 13 at a position downstream of the NOx removing device 15. Detection signals from these sensors 18 and 19 are supplied to the ECU 5. Each of the O2 sensors 18 and 19 has a characteristic such that its output rapidly changes in the vicinity of the stoichiometric ratio. More specifically, the output from each of the sensors 18 and 19 has a high level in a rich region with respect to the stoichiometric ratio, and outputs a low level signal in a lean region with respect to the stoichiometric ratio.

The engine 1 has a valve timing switching mechanism 30 capable of switching the valve timing of intake valves and exhaust valves between a high-speed valve timing suitable for a high-speed operating region of the engine 1 and a low-speed valve timing suitable for a low-speed operating region of the engine 1. This switching of the valve timing also includes switching of a valve lift amount. Further, when selecting the low-speed valve timing, one of the two intake valves in each cylinder is stopped to ensure stable combustion even in the case of setting the air-fuel ratio lean with respect to the stoichiometric ratio.

The valve timing switching mechanism 30 is of such a type that the switching of the valve timing is carried out hydraulically. That is, a solenoid valve for performing the hydraulic switching and an oil pressure sensor are connected to the ECU 5. A detection signal from the oil pressure sensor is supplied to the ECU 5, and the ECU 5 controls the solenoid valve to perform the switching control of the valve timing according to an operating condition of the engine 1.

A vehicle speed sensor 20 detects the running speed (vehicle speed) VP of a vehicle driven by engine 1. The speed sensor 20 is connected to the ECU 5, and supplies a detection signal to the ECU 5.

The ECU 5 includes an input circuit 5*a* having various functions including a function of shaping the waveforms of input signals from the various sensors, a function of correcting the voltage levels of the input signals to a predetermined level, and a function of converting analog signal values into digital signal values, a central processing unit (which will be hereinafter referred to as "CPU") 5*b*, a memory set 5*c* consisting of a ROM (read only memory) preliminarily stores various operational programs to be executed by the CPU 5*b*, and a RAM (random access memory) for storing the results of computation or the like by the CPU 5*b*, and an output circuit 5*d* for supplying drive signals to the fuel injection valves 6.

The CPU 5*b* determines various engine operating conditions according to various engine operating parameter signals as mentioned above, and calculates a fuel injection period TOUT of each fuel injection valve 6 to be opened in synchronism with the TDC signal pulse, in accordance with Eq. (1) according to the above determined engine operating conditions.

$$TOUT=TIM\times KCMD\times KLAF\times K1+K2 \quad (1)$$

TIM is a basic fuel amount, more specifically, a basic fuel injection period of each fuel injection valve 6, and it is determined by retrieving a TI map set according to the engine rotational speed NE and the absolute intake pressure PBA. The TI map is set so that the air-fuel ratio of an air-fuel mixture to be supplied to the engine 1 becomes substantially equal to the stoichiometric ratio in an operating condition according to the engine rotational speed NE and the absolute intake pressure PBA. That is, the basic fuel amount TIM has a value substantially proportional to an intake air amount (mass flow) per unit time by the engine.

KCMD is a target air-fuel ratio coefficient, which is set according to engine operational parameters such as the engine rotational speed NE, the throttle valve opening angle θ TH, and the engine coolant temperature TW. The target air-fuel ratio coefficient KCMD is proportional to the reciprocal of an air-fuel ratio A/F, i.e., proportional to a fuel-air ratio F/A, and takes a value of 1.0 for the stoichiometric ratio, so KCMD is referred to also as a target equivalent ratio. Further, in the case of executing reduction enrichment or determination of deterioration of the NOx removing device 15 to be hereinafter described, the target air-fuel ratio coefficient KCMD is set to a predetermined enrichment value KCMDRR or KCMDRM for enrichment of an air-fuel ratio.

KLAF is an air-fuel ratio correction coefficient calculated by PID (Proportional Integral Differential) control so that a detected equivalent ratio KACT calculated from a detected value from the LAF sensor 17 becomes equal to the target equivalent ratio KCMD in the case that the conditions for execution of feedback control are satisfied.

K1 and K2 are respectively a correction coefficient and a correction variable computed according to various engine parameter signals, respectively. The correction coefficient K1 and correction variable K2 are predetermined values that optimize various characteristics such as fuel consumption characteristics and engine acceleration characteristics, according to engine operating conditions.

The CPU 5*b* supplies a drive signal for opening each fuel injection valve 6 according to the fuel injection period TOUT obtained above through the output circuit 5*d* to the fuel injection valve 6.

Figure 2:
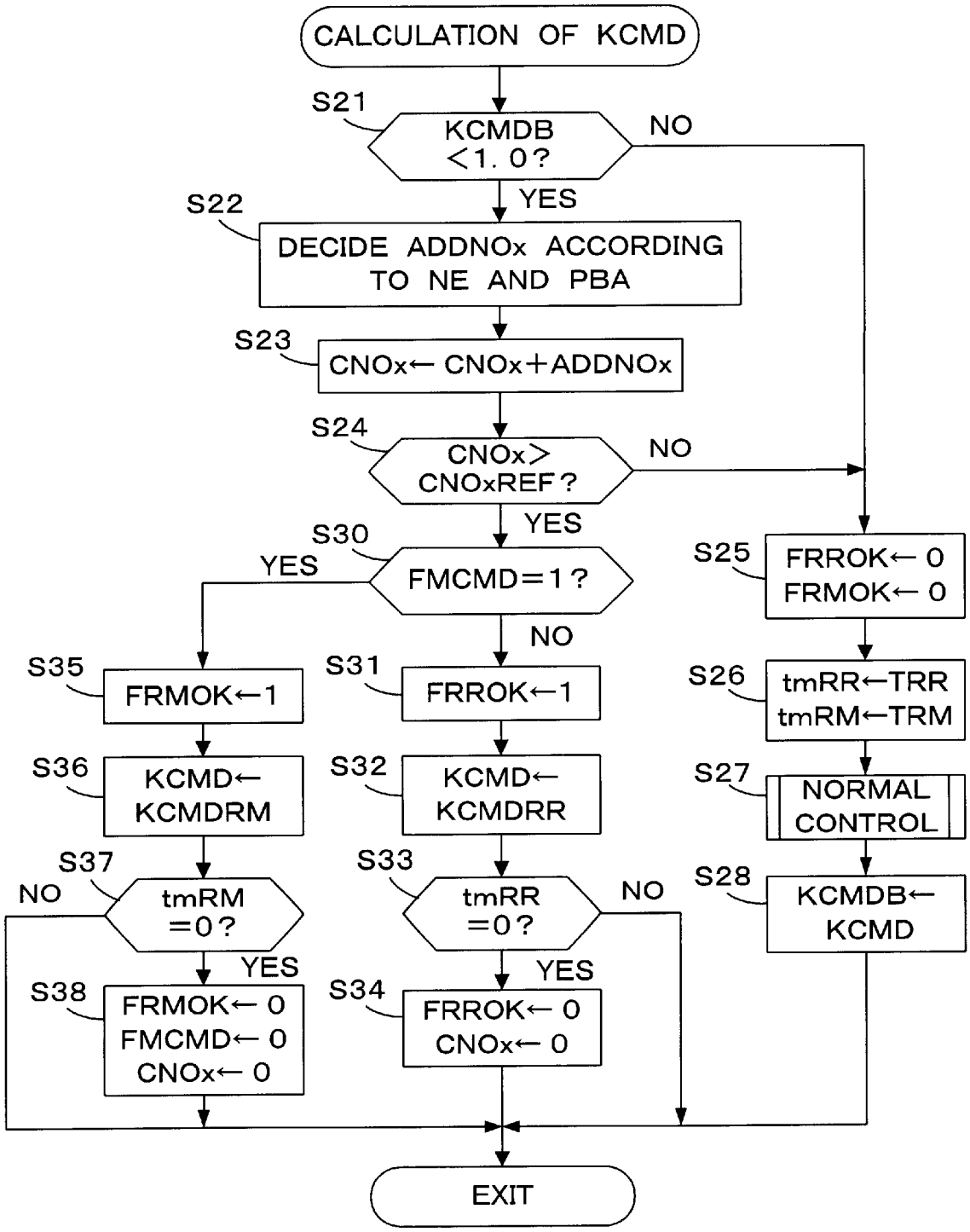
FIG. 2 is a flowchart showing a program for calculating a target air-fuel ratio coefficient (KCMD) in the preferred embodiment.

FIG. 2 is a flowchart showing a program for calculating the target air-fuel ratio coefficient KCMD applied to Eq. (1) mentioned above. This program is executed by the CPU 5*b* at predetermined time intervals.

In step S21, it is determined whether or not the engine 1 is in a lean operating condition, that is, whether or not a stored value KCMDB of the target air-fuel ratio coefficient KCMD stored in step S28, to be hereinafter described during normal control is less than "1.0". If KCMDB is greater than or equal to "1.0", that is, if the engine 1 is not in the lean operating condition, the program proceeds directly to step S25, in which a reduction enrichment flag FRROK indicating the duration of execution of reduction enrichment by "1" is set to "0", and a deterioration determination enrichment flag FRMOK indicating the duration of execution of air-fuel ratio enrichment for determination of deterioration of the NOx removing device 15 by "1" is also set to "0". Thereafter, a reduction enrichment time TRR (e.g., 5 to 10 sec) is set to a downcount timer tmRR to be referred to in step S33, described below, and a deterioration determination enrichment time TRM, which is longer than the reduction enrichment time TRR, is set to a downcount timer tmRM to be referred in step S37, also described below. Then, the timers tmRR and tmRM are started (step S26). Normal control is performed to set the target air-fuel ratio coefficient KCMD according to engine operating conditions (step S27). Basically, the target air-fuel ratio coefficient KCMD is set according to the engine rotational speed NE and the absolute intake pressure PBA. However, in the condition where the engine coolant temperature TW is low or engine 1 is in a predetermined high-load operating condition, the value of the target air-fuel ratio coefficient KCMD is set according to these conditions. Then, the target air-fuel ratio coefficient KCMD calculated in step S27 is stored as a stored value KCMDB (step S28), and this program ends.

If KCMDB is less than "1.0" in step S21, that is, if the engine 1 is in the lean operating condition, an increment value ADDNOx to be used in step S23 is determined according to the engine rotational speed NE and the absolute intake pressure PBA (step S22). The increment value ADDNOx is a parameter corresponding to the amount of NOx exhausted per unit time during the lean operation. This parameter increases with an increase in the engine rotational speed NE and with an increase in the absolute intake pressure PBA.

In step S23, the increment value ADDNOx decided in step S22 is applied to the following expression to increment a NOx amount counter CNOx, thereby obtaining a NOx exhaust amount, that is, a count value corresponding to the amount of NOx absorbed by the NOx absorbent.

$$CNOx=CNOx\times ADDNOx$$

In step S24, it is determined whether or not the current value of the NOx amount counter CNOx has exceeded an allowable value CNOxREF. If the answer to step S24 is negative (NO), the program proceeds to step S25, in which the normal control is performed, that is, the target air-fuel ratio coefficient KCMD is set according to engine operating conditions. The allowable value CNOxREF is set to a value corresponding to a NOx amount slightly smaller than the maximum NOx absorption amount of the NOx absorbent.

If CNOx is greater than CNOxREF in step S24, then it is determined whether or not a deterioration determination command flag FMCMD is "1" (step S30). When this flag is set to "1", it indicates that the execution command for the deterioration determination for the NOx removing device 15 is active. It is sufficient to execute the deterioration determination for the NOx removing device 15 about once per engine operation period (a period from starting to stopping of the engine). Therefore, the deterioration determination command flag FMCMD is set to "1" at the time the engine operating condition becomes stable after starting the engine.

Initially, the flag FMCMD is set to "0". Therefore, the program proceeds from step S30 to step S31, in which the reduction enrichment flag FRROK is set to "1". Subsequently, the target air-fuel ratio coefficient KCMD is set to a predetermined enrichment value KCMDRR corresponding to a value equivalent to an air-fuel ratio of e.g., 14.0, thus executing reduction enrichment (step S32). Then, it is determined whether or not the current value of the timer tmRR is "0" (step S33). If tmRR is not "0", this program ends. When tmRR equals "0", the reduction enrichment flag FRROK is set to "0" and the current value of the NOx amount counter CNOx is reset to "0" (step S34). Accordingly, the answer to step S24 subsequently becomes negative (NO), so that the normal control is then performed.

If CNOx is greater than CNOxREF in step S24, in the condition where the deterioration determination command has been issued (FMCMD=1), the program proceeds from step S30 to step S35, in which the deterioration determination enrichment flag FRMOK is set to "1". Subsequently, the target air-fuel ratio coefficient KCMD is set to a predetermined deterioration determination enrichment value KCMDRM (1<KCMDRM<KCMDRR) corresponding to a value slightly shifted to the lean region from a value equivalent to an air-fuel ratio of e.g., 14.0, thus executing deterioration determination enrichment (step S36). The reason for making the degree of enrichment smaller in the execution of deterioration determination than the degree of enrichment of the usual reduction enrichment is that if the degree of enrichment is large and the enrichment execution time is short, an improper determination may occur. Accordingly, by reducing the degree of enrichment and increasing the enrichment execution time TRM, the accuracy of deterioration determination can be improved.

Subsequently, it is determined whether or not the current value of the timer tmRM is "0" (step S37). If tmRM does not equal 0, this program ends. When tmRM equals "0", both the deterioration determination enrichment flag FRMOK and the deterioration determination command flag FMCMD are set to "0", and the current value of the NOx amount counter CNOx is reset to "0" (step S38). Accordingly, the answer to step S24 subsequently becomes negative (NO), so that the normal control is then performed.

Figure 3:
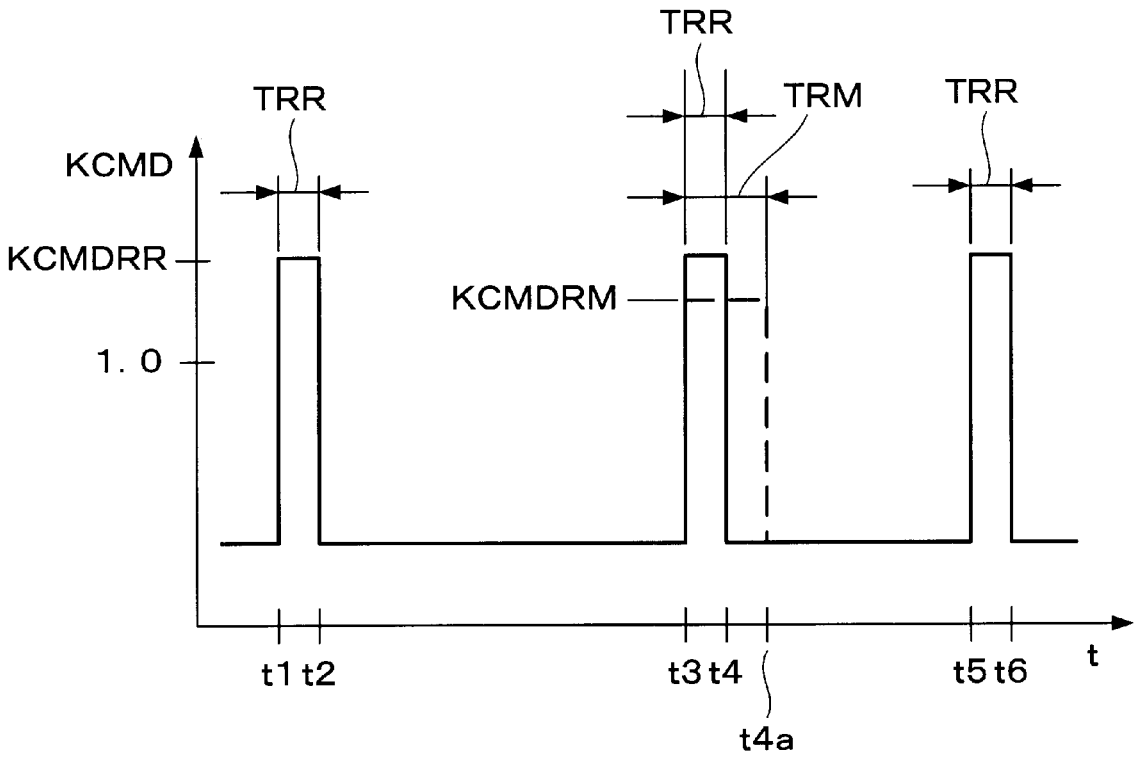
FIG. 3 is a time chart for illustrating the setting of the target air-fuel ratio coefficient during a lean operation.

According to the process shown in FIG. 2, the reduction enrichment is executed intermittently as shown by a solid line in FIG. 3 (during a time period between t1 and t2, a time period between t3 and t4, and a time period between t5 and t6) in an engine operating condition where the lean operation is permitted, so that NOx absorbed by the NOx absorbent in the NOx removing device 15 is discharged at appropriate intervals. Further, in the case that the deterioration determination command is issued before the time t3, for example, the deterioration determination enrichment is executed so that the degree of enrichment is made smaller than the degree of the reduction enrichment and that the execution time period is made longer (TRM=a time period between t3 and t4*a*) than the execution time period of the reduction enrichment.

Figure 4:
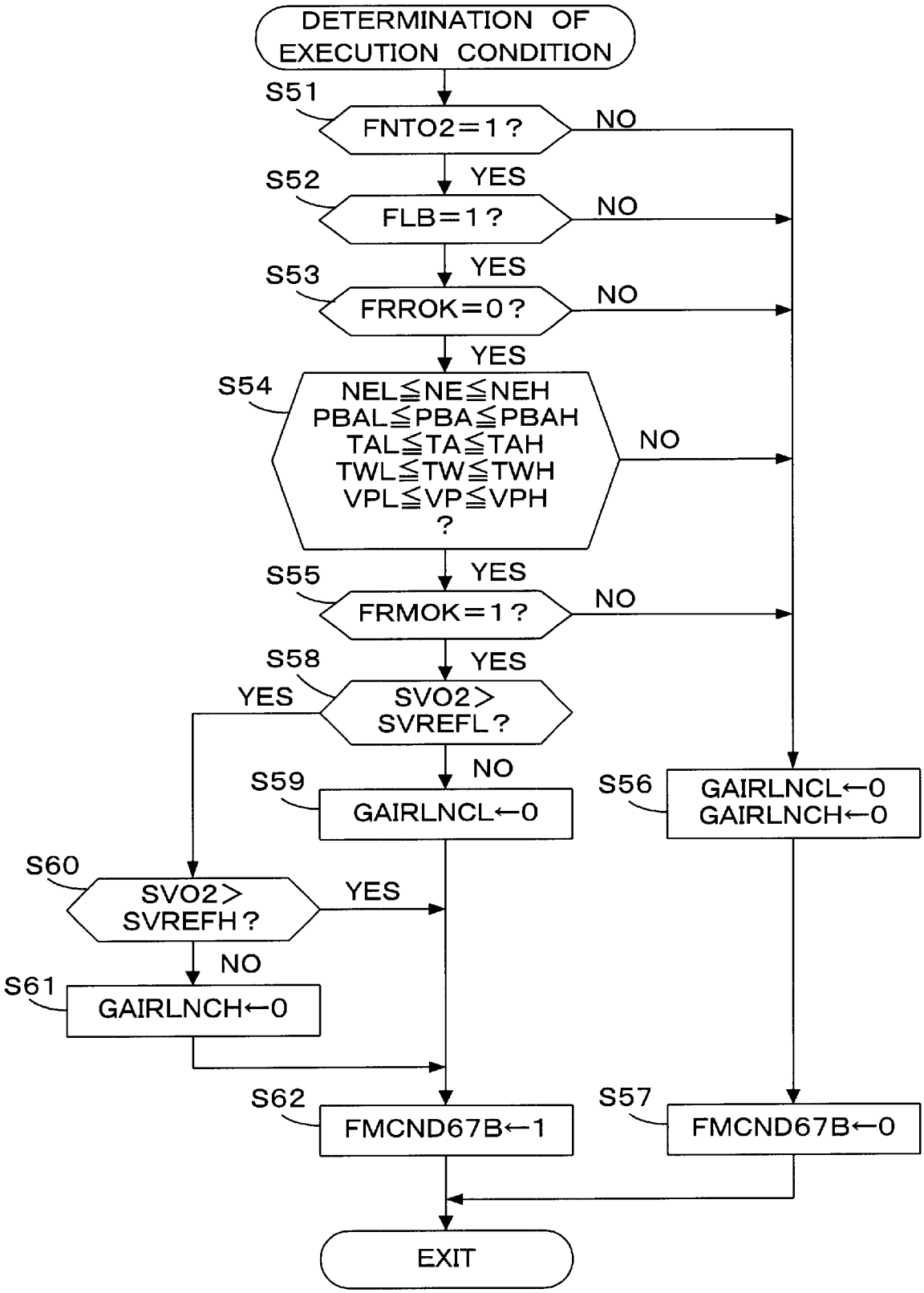
FIG. 4 is a flowchart showing a program for determining execution conditions of deterioration determination of a NOx removing device.

FIG. 4 is a flowchart showing a program for determining an execution condition of deterioration determination for the NOx removing device 15. This program is executed by the CPU 5*b* in synchronism with the generation of a TDC signal pulse.

In step S51, it is determined whether or not an activation flag FNTO2 is "1". When the flag FNTO2 is set to "1", this indicates that the downstream O2 sensor 19 is activated. If FNTO2 is "1", that is, if the downstream O2 sensor 19 has been activated, it is then determined whether or not a lean operation flag FLB is "1" (step S52). When the flag FLB is set to "1", this indicates that a lean operation, in which the air-fuel ratio is set in a lean region with respect to the stoichiometric ratio. If FLB is "1", it is then determined whether or not the reduction enrichment flag FRROK is "0" (step S53).

If the answer to any one of steps S51 to S53 is negative (NO), a first exhaust amount parameter GAIRLNCL and a second exhaust amount parameter GAIRLNCH to be calculated and used in the process shown in FIG. 5 described below are set to "0" (step S56), and an execution condition flag FMCND67B is set to "0" (step S57). The flag FMCND67B, when set to "1", indicates that the execution condition of the deterioration determination is satisfied. Then, this program ends.

If the answers to all of steps S51 to S53 are affirmative (YES), it is then determined whether or not the engine operating condition is normal (step S54). More specifically, it is determined whether or not the engine speed NE is in the range between a predetermined upper limit NEH (e.g., 3000 rpm) and a predetermined lower limit NEL (e.g., 1200 rpm), the absolute intake pressure PBA is in the range between a predetermined upper limit PBAH (e.g., 88 kPa) and a predetermined lower limit PBAL (e.g., 21 kPa), the intake air temperature TA is in the range between a predetermined upper limit TAH (e.g., 100° C. ) and a predetermined lower limit TAL (e.g., −7° C. ), the engine coolant temperature TW is in the range between a predetermined upper limit TWH (e.g., 100° C. ) and a predetermined lower limit TWL (e.g., 75° C. ), and the vehicle speed VP is in the range between a predetermined upper limit VPH (e.g., 120 km/h) and a predetermined lower limit VPL (e.g., 35 km/h). If at least one of these conditions is not satisfied, the answer to step S54 becomes negative (NO) and the program proceeds to step S56. If all of these conditions are satisfied, the answer to step S54 becomes affirmative (YES) and the program proceeds to step S55, in which it is determined whether or not the deterioration determination enrichment flag FRMOK is "1".

Until the NOx amount absorbed by the NOx absorbent in the NOx removing device 15 becomes almost maximum (saturated condition) and the deterioration determination enrichment flag FRMOK is set to "1" in the processing of FIG. 2, the program proceeds from step S55 to step S56. If FRMOK equals "1", it is then determined whether or not an output voltage SVO2 from the upstream O2 sensor 18 has exceeded a first upstream reference voltage SVREFL (e.g., 0.3 V) (step S58). During a certain period of time after starting the deterioration determination enrichment, HC and CO are oxidized by the three-way catalyst 14, so that the output voltage SVO2 continues to be less than the reference voltage SVREFL. Accordingly, the program proceeds from step S58 to step S59, in which the first exhaust amount parameter GAIRLNCL is set to "0". Then, the execution condition flag FMCND67B is set to "1" (step S62), and this program ends.

When the oxygen accumulated in the three-way catalyst 14 becomes absent, resulting in the exhaust rich condition in the vicinity of the O2 sensor 18, and the output voltage SVO2 exceeds the first upstream reference voltage SVREFL, the program proceeds to step S60, in which it is determined whether or not the output voltage SVO2 exceeds a second upstream reference voltage SVREFH (e.g., 0.6 V) greater than the first upstream reference voltage SVREFL. Since SVO2 is less than SVREFH at first, the second exhaust amount parameter GAIRLNCH is set to "0" (step S61) and the program then proceeds to step S62. If SVO2 becomes greater than SVREFH, the program proceeds from step S60 directly to step S62 without executing step S61.

Figure 5:
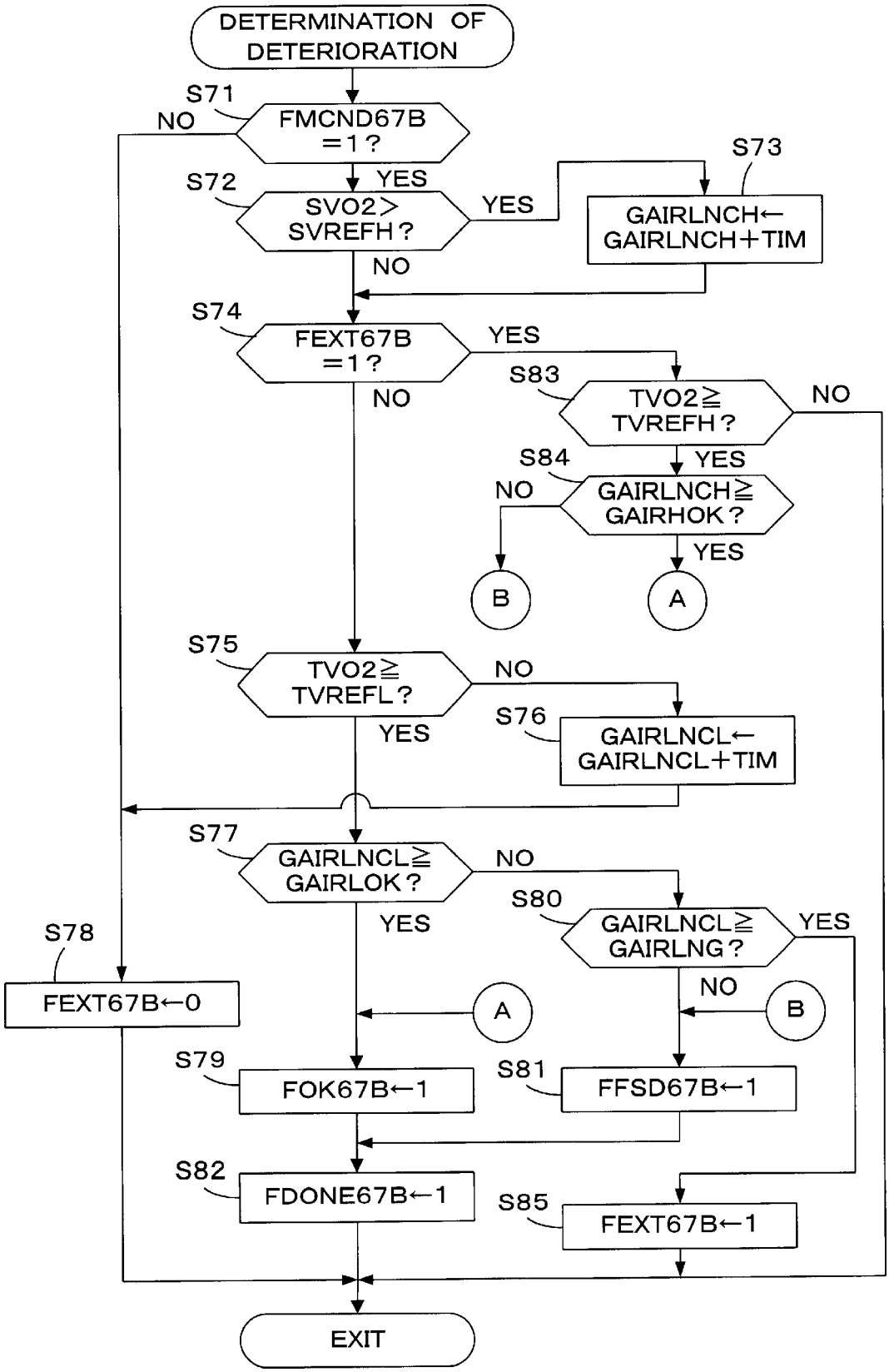
FIG. 5 is a flowchart showing a program for executing the deterioration determination of the NOx removing device in the preferred embodiment.

FIG. 5 is a flowchart showing a program for determining the deterioration of the NOx removing device 15. This program is executed by the CPU 5*b* in synchronism with the generation of a TDC signal pulse.

In step S71, it is determined whether or not the execution condition flag FMCND67B is "1". If FMCND67B is "0", which indicates that the execution condition is not satisfied, a determination withholding flag FEXT67B to be referred in step S74 is set to "0" (step S78), and this program then ends. In the case that the NOx removing device 15 is determined to be in a condition intermediate between a normal condition and a deteriorated condition by steps S75 to S77 and S80, the determination withholding flag FEXT67B is set to "1" (step S85).

If FMCND67B is "1" in step S71, it is determined whether or not the output voltage SVO2 from the upstream O2 sensor 18 exceeds the second upstream reference voltage SVREFH (step S72). Since SVO2 is less than SVREFH at first, the program immediately proceeds to step S74, in which it is determined whether or not the determination withholding flag FEXT67B is "1" (step S74). Since FEXT67B is "0" at first, the program proceeds to step S75, in which it is determined whether or not an output voltage TVO2 from the downstream O2 sensor 19 is greater than or equal to a first downstream reference voltage TVREFL (e.g., 0.3 V) is substantially equal to the first upstream reference voltage SVREFL. Immediately after the execution condition flag FMCND67B becomes "1", TVO2 is less than TVREFL. Accordingly, the program proceeds to step S76, in which the first exhaust amount parameter GAIRLNCL is calculated from Eq. (2) shown below.

$$GAIRLNCL=GAIRLNCL+TIM \quad (2)$$

Where TIM is a basic fuel amount, which is set so that the air-fuel ratio becomes the stoichiometric ratio according to an engine operating condition (engine speed NE and absolute intake pressure PBA). Accordingly, TIM is a parameter proportional to an intake air amount per unit time by the engine 1. In other words, TIM is a parameter proportional to an exhaust amount per unit time by the engine 1. While SVO2 is less than or equal to SVREFL, the exhaust amount parameter GAIRLNCL is kept at "0" by the process of FIG. 4. Accordingly, from the time the output voltage SVO2 from the upstream O2 sensor 18 exceeds the first upstream reference voltage SVREFL, the first exhaust amount parameter GAIRLNCL, which is indicative of an integrated value of the amount of exhaust gases flowing into the NOx removing device 15 is obtained by the calculation of step S76. Further, during execution of the deterioration determination, the air-fuel ratio is maintained at a fixed rich air-fuel ratio (a value corresponding to KCMDRM) in a rich region with respect to the stoichiometric ratio. Therefore, this exhaust amount parameter GAIRLNCL has a value proportional to an integrated value of the amount of reducing components (HC and CO) contained in the exhaust gases.

If TVO2 becomes greater than or equal to TVREFL in step S75, the program proceeds to step S77, in which it is determined whether or not the first exhaust amount parameter GAIRLNCL is greater than or equal to an OK determination threshold GAIRLOK. If GAIRLNCL is greater than or equal to GAIRLOK, the NOx removing device 15 is determined to be normal, and a normality flag FOK67B is set to "1" (step S79), indicating that the NOx removing device 15 is normal. Then, an end flag FDONE67B is set to "1" (step S82), indicating that the deterioration determination is finished, and this program ends.

If GAIRLNCL is less than GAIRLOK in step S77, it is determined whether or not the first exhaust amount parameter GAIRLNCL is greater than or equal to an NG determination threshold GAIRLNG, which is less than the OK determination threshold GAIRLOK (step S80). If GAIRLNCL is less than GAIRLNG, the NOx removing device 15 is determined to be deteriorated (the degree of deterioration is determined to be an unusable level), and a deterioration flag FFSD67B is set to "1" (step S81), indicating that the NOx removing device 15 is deteriorated. Then, the program proceeds to step S82.

If GAIRLNCL is greater than or equal to GAIRLNG in step S80, the determination withholding flag FEXT67B is set to "1" (step S85), and this program ends. After execution of step S85, the program proceeds from step S74 to step S83.

In the case that the NOx removing device 15 is normal, a value GAIRLNCLR of the first exhaust amount parameter GAIRLNCL ("GAIRLNCLR" will be hereinafter referred to as "first rich inversion parameter value"), at the time the downstream O2 sensor output TVO2 has reached the first downstream reference voltage TVREFL, becomes greater than the OK determination threshold GAIRLOK even in consideration of differences in characteristics of a plurality of NOx removing devices. In other words, the OK determination threshold GAIRLOK is set as a threshold according to which the NOx removing device 15 can be reliably determined to be normal even in consideration of differences in characteristics of a plurality of NOx removing devices. Further, the NG determination threshold GAIRLNG is set as a threshold according to which the NOx removing device 15 can be reliably determined to be deteriorated even in consideration of differences in characteristics of a plurality of NOx removing devices. When the first rich inversion parameter value GAIRLNCLR is in the range between the NG determination threshold GAIRLNCNG and the OK determination threshold GAIRLNCOK, the determination of whether the NOx removing device 15 is normal or deteriorated is withheld, and the determination using the second exhaust amount parameter GAIRLNCH is performed as described below.

If the upstream O2 sensor output SVO2 exceeds the second upstream reference voltage SVREFH in step S72, the second exhaust amount parameter GAIRLNCH is calculated from Eq. (3) shown below (step S73). Eq. (3) is obtained by substituting "GAIRLNCH" for "GAIRLNCL" in Eq. (2).

$$GAIRLNCH=GAIRLNCH+TIM \quad (3)$$

By steps S72 and S73, the second exhaust amount parameter GAIRLNCH indicative of an integrated value of the amount of exhaust gases flowing into the NOx removing device 15 from the time the upstream O2 sensor output SVO2 exceeds the second upstream reference voltage SVREFH, is obtained. Further, during execution of deterioration determination, the air-fuel ratio is maintained at a fixed rich air-fuel ratio (a value corresponding to KCMDRM) in a rich region with respect to the stoichiometric ratio. Accordingly, this second exhaust amount parameter GAIRLNCH also has a value proportional to an integrated value of the amount of reducing components (HC and CO) contained in the exhaust gases.

When the determination withholding flag FEXT67B is set to "1" in step S85, the program proceeds from step S74 to step S83, in which it is determined whether or not the downstream O2 sensor output TVO2 is greater than or equal to a second downstream reference voltage TVREFH (e.g., 0.6 V) substantially equal to the second upstream reference voltage SVREFH. Since TVO2 is less than TVREFH, this program ends at once. If TVO2 becomes greater than or equal to TVREFH, it is then determined whether or not the second exhaust amount parameter GAIRLNCH is greater than or equal to a predetermined determination threshold GAIRHOK (step S84). If the second exhaust amount parameter GAIRLNCH is greater than or equal to the predetermined determination threshold GAIRHOK, it is determined that the NOx removing device 15 is normal, and the program proceeds to step S79. In contrast, if GAIRLNCH is less than GAIRHOK, it is determined that the NOx removing device 15 is deteriorated (the degree of deterioration is an unusable level), and the program proceeds to step S81.

The processing of FIG. 5 is summarized as follows:

1) If the first exhaust amount parameter GAIRLNCL is greater than or equal to the OK determination threshold GAIRLOK at the time the downstream O2 sensor output TVO2 has reached the first downstream reference voltage TVREFL, it is determined that the NOx removing device 15 is normal (steps S75, S77, and S79).
2) If the first exhaust amount parameter GAIRLNCL is less than the NG determination threshold GAIRLNG at the time the downstream O2 sensor output TVO2 has reached the first downstream reference voltage TVREFL, it is determined that the NOx removing device 15 is deteriorated (steps S75, S77, S80, and S81).
3) If the first exhaust amount parameter GAIRLNCL is greater than or equal to the NG determination threshold GAIRLNG and less than the OK determination threshold GAIRLOK at the time the downstream O2 sensor output TVO2 has reached the first downstream reference voltage TVREFL, the determination of whether the NOx removing device 15 is normal or deteriorated is withheld (steps S75, S77, S80, and S85). Subsequently, the following determination is performed.

3A) If the second exhaust amount parameter GAIRLNCH is greater than or equal to the predetermined determination threshold GAIRHOK at the time the downstream O2 sensor output TVO2 has reached the second downstream reference voltage TVREFH, it is determined that the NOx removing device 15 is normal (steps S83, S84, and S79).

3B) If the second exhaust amount parameter GAIRLNCH is less than the predetermined determination threshold GAIRHOK at the time the downstream O2 sensor output TVO2 has reached the second downstream reference voltage TVREFH, it is determined that the NOx removing device 15 is deteriorated (steps S83, S84, and S81).

In the preferred embodiment as mentioned above, the first exhaust amount parameter GAIRLNCL, which is indicative of an integrated value of the amount of exhaust gases (i.e., the amount of reducing components) flowing into the NOx removing device 15 from the time the output SVO2 from the upstream O2 sensor 18 has reached the first upstream reference voltage SVREFL is calculated, and the second exhaust amount parameter GAIRLNCH, which is indicative of an integrated value of the amount of exhaust gases (i.e., the amount of reducing components) flowing into the NOx removing device 15 from the time the upstream O2 sensor output SVO2 has reached the second upstream reference voltage SVREFH is calculated. Then, the deterioration of the NOx removing device 15 is determined according to the first and second exhaust amount parameters GAIRLNCL and GAIRLNCH and the downstream O2 sensor output TVO2. A value GAIRLNCHR of the second exhaust amount parameter GAIRLNCH ("GAIRLNCHR" will be hereinafter referred to as "second rich inversion parameter value"), at the time the downstream O2 sensor output TVO2 exceeds the second downstream reference voltage TVREFH, is less susceptible to the degree of deterioration of the three-way catalyst 14 provided upstream of the NOx removing device 15 compared with the first rich inversion parameter value GAIRLNCLR. Accordingly, the use of the first and second exhaust amount parameters GAIRLNCL and GAIRLNCH allows accurate determination of deterioration.

If the engine operating condition is substantially constant during the execution of deterioration determination (i.e., if the engine operating condition where the deterioration determination is permitted is limited in a relatively narrow range of engine rotational speed and a relatively narrow range of absolute intake pressure), the first and second exhaust amount parameters GAIRLNCL and GAIRLNCH may be replaced by a first delay time period TDLY1 and a second delay time period TDLY2. That is, the deterioration of the NOx removing device 15 may be determined according to the first delay time period TDLY1 from the time the upstream O2 sensor output SVO2 has reached the first upstream reference voltage SVREFL to the time the downstream O2 sensor output TVO2 reaches the first downstream reference voltage TVREFL, and according to the second delay time period TDLY2 from the time the upstream O2 sensor output SVO2 has reached the second upstream reference voltage SVREFH to the time the downstream O2 sensor output TVO2 reaches the second downstream reference voltage TVREFH. In this case, the basic fuel amount TIM may be changed to a constant value ΔT in Eqs. (2) and (3) for calculation of the first and second exhaust amount parameters GAIRLNCL and GAIRLNCH, whereby each exhaust amount parameter becomes a parameter that corresponds to the constant engine operating condition and is proportional to an elapsed time period. Further, the deterioration determination thresholds GAIRLOK, GAIRLNG, and GAIRHOK may be suitably set according to the degree of deterioration to be detected.

Figure 6A:
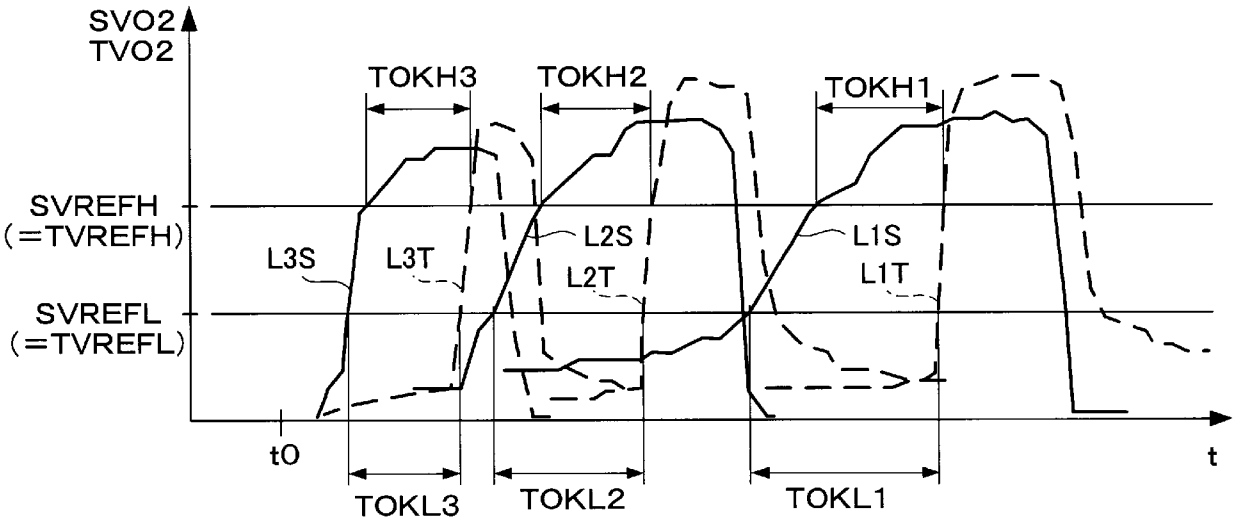
FIGS. 6A and 6B are time charts for illustrating changes in output values from two oxygen concentration sensors with time.
Figure 6B:
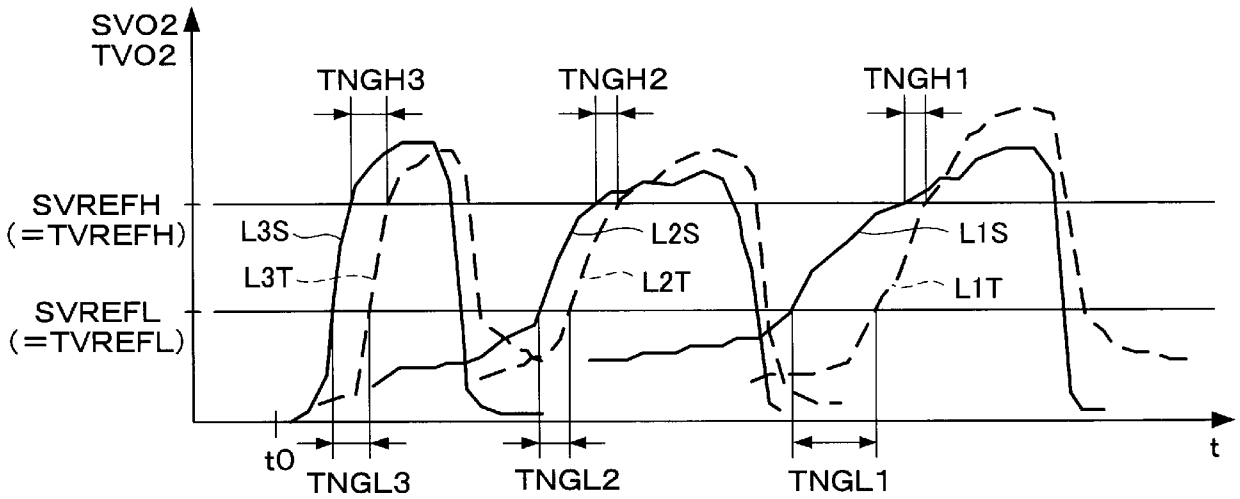

FIGS. 6A and 6B show changes in the upstream O2 sensor output SVO2 and the downstream O2 sensor output TVO2 with time in relation to three-way catalysts and NOx removing devices having different degrees of deterioration in the case where the engine operating condition is constant and the air-fuel ratio is changed to a rich air-fuel ratio at time tO. In FIGS. 6A and 6B, delay time periods TOKL1, TOKL2, TOKL3, TNGL1, TNGL2, and TNGL3 correspond to the above-mentioned first delay time period TDLY1, and delay time periods TOKH1, TOKH2, TOKH3, TNGH1, TNGH2, and TNGH3 correspond to the above-mentioned second delay time period TDLY2. Further, FIG. 6A shows data related to a normal NOx removing device, and FIG. 6B shows data related to a deteriorated NOx removing device. Further, the solid lines L1S, L2S, and L3S in FIGS. 6A and 6B show changes in the upstream O2 sensor output SVO2, and the broken lines L1T, L2T, and L3T in FIGS. 6A and 6B show changes in the downstream O2 sensor output TVO2. The solid line L1S and the broken line L1T show data in the case that a new three-way catalyst is used. The solid line L2S and the broken line L2T show data in the case that a three-way catalyst after traveling a distance of 80,000 km is used. The solid line L3S and the broken line L3T show data in the case that a more deteriorated three-way catalyst is used.

In the case of the normal NOx removing device, as the three-way catalyst becomes more deteriorated, the first delay time period TDLY1 becomes shorter (TOKL1>TOKL2>TOKL3). Furthermore, the shortest delay time period TOKL3 is considerably near the longest delay time period TNGL1 corresponding to the deteriorated NOx removing device. Accordingly, if only the first delay time period TDLY1 is used for the determination, it is difficult to accurately distinguish between the normal NOx removing device and the deteriorated NOx removing device.

On the other hand, in the case of the deteriorated NOx removing device, the second delay time period TDLY2 does not largely change with a change in the degree of deterioration of the three-way catalyst (the delay time periods TNGH1, TNGH2, and TNGH3 are not largely different from each other), and can be clearly distinguished from the shortest delay time period TOKH3 of the normal NOx removing device. However, the second delay time period TDLY2 is more susceptible to a difference in response characteristics (variations in response characteristics) between the upstream O2 sensor and the downstream O2 sensor than the first delay time period TDLY1. Therefore, by using both the first delay time period TDLY1 and the second delay time period TDLY2, the deterioration of the NOx removing device can be accurately determined.

Therefore, in this preferred embodiment, the determination using the second delay time period TDLY2 is performed when the first delay time period TDLY1 is near the time period TOKL3. That is, in the processing of FIG. 5, the determination using the second exhaust amount parameter GAIRLNCH is performed when the determination withholding flag FEXT67B is set to "1" (steps S83 and S84), thereby allowing accurate determination of deterioration.

In this preferred embodiment, the ECU 5 constitutes an air-fuel ratio switching module, a first measuring module, a second measuring module, a deterioration determining module, a first reducing-component amount calculating module, and a second reducing-component amount calculating module. More specifically, step S36 in FIG. 2 corresponds to the air-fuel ratio switching module. Steps S58 and S59 in FIG. 4 and steps S75 and S76 in FIG. 5 correspond to the first measuring module, or the first reducing-component amount calculating module. Steps S60 and S61 in FIG. 4 and steps S73 and S83 in FIG. 5 correspond to the second measuring module, or the second reducing-component amount calculating module. Steps S77, S80, and S84 in FIG. 5 correspond to the deterioration determining module. The ROM of ECU 5 corresponds to a computer readable medium storing computer executable instructions for causing a computer (CPU 5*b*) to carry out a method for determining deterioration of the NOx removing device.

The present invention is not limited to the above preferred embodiment, but various modifications may be made. For example, the processing of FIG. 5 may be modified as shown in FIG. 7.

Figure 7:
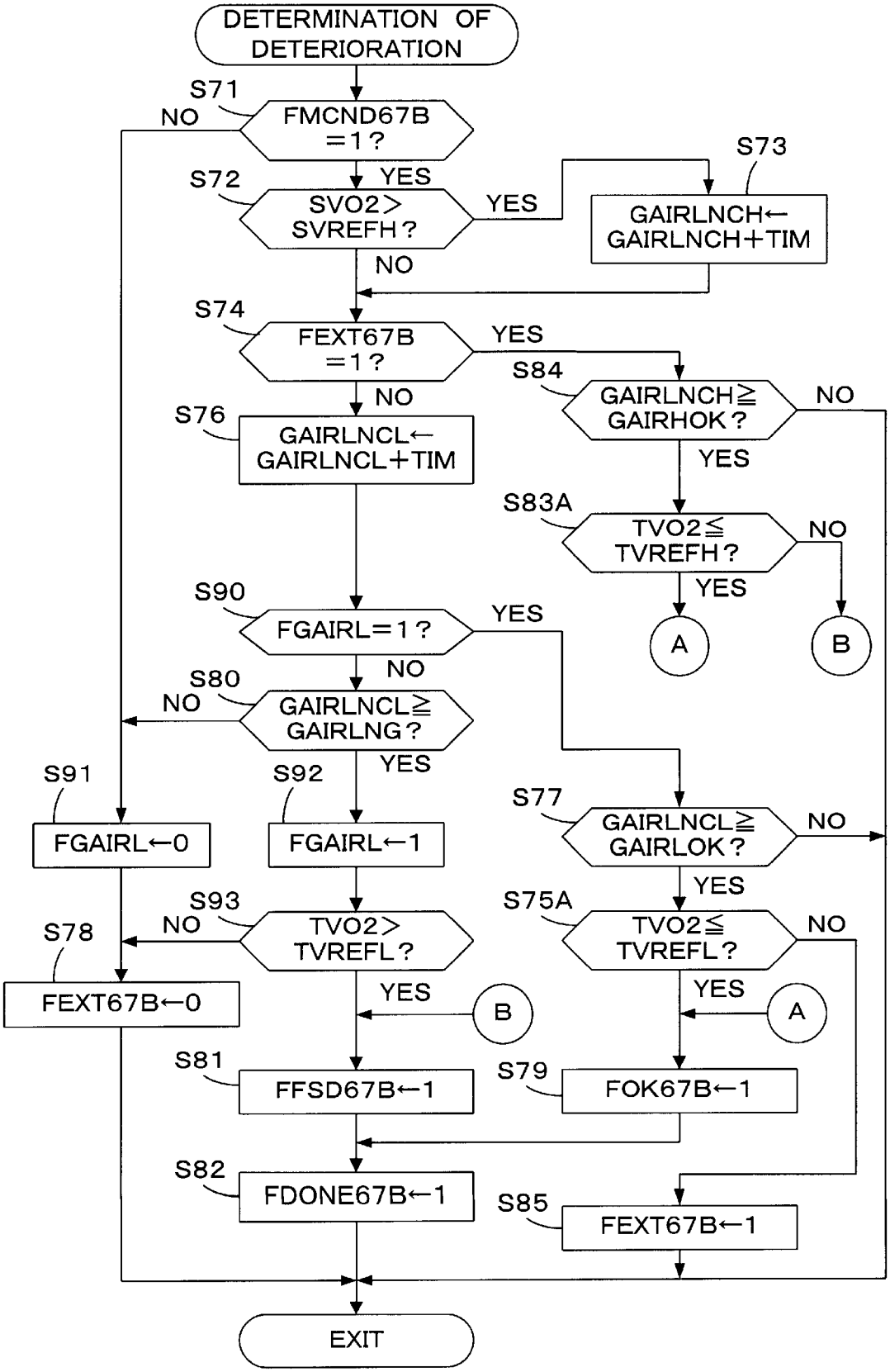
FIG. 7 is a flowchart showing a modification of the process shown in FIG. 5.

The process of FIG. 7 is provided by changing the positions of steps S75 to S77, S79 to S81, S83, and S84 in FIG. 5, changing steps S75 and S83 respectively to steps S75A and S83A, and adding steps S91 to S93.

If FMCND67B is "0", which indicates that the execution condition of deterioration determination is not satisfied, an NG determination end flag FGAIRL is set to "0" (step S91), indicating that an NG determination according to the first exhaust amount parameter GAIRLNCL and the downstream O2 sensor output TVO2 is not finished, and the program proceeds to step S78.

If the determination withholding flag FEXT67B is "0", the program proceeds from step S74 through step S76 to step S90, in which it is determined whether or not the NG determination end flag FGAIRL is "1". Since the flag FGAIRL is "0" at first, it is determined whether or not the first exhaust amount parameter GAIRLNCL is greater than or equal to the NG determination threshold GAIRLNG (step S80). If GAIRLNCL is less than GAIRLNG, the program proceeds to step S91. If GAIRLNCL becomes greater than or equal to GAIRLNG, the NG determination end flag FGAIRL is set to "1" (step S92), and it is then determined whether or not the downstream O2 sensor output TVO2 is greater than the first downstream reference voltage TVREFL (step S93). If TVO2 is less than or equal to TVREFL, the program proceeds to step S78. If TVO2 is greater than TVREFL, it is determined that the NOx removing device 15 is deteriorated (the degree of deterioration is an unusable level), and the deterioration flag FFSD67B is set to "1" (step S81).

After the NG determination end flag FGAIRL is set to "1", the program proceeds from step S90 to step S77, in which it is determined whether or not the first exhaust amount parameter GAIRLNCL is greater than or equal to the OK determination threshold GAIRLOK. If GAIRLNCL is less than GAIRLOK, the program ends at once. If GAIRLNCL becomes greater than or equal to GAIRLOK, it is determined whether or not the downstream O2 sensor output TVO2 is less than or equal to the first downstream reference voltage TVREFL (step S75A). If TVO2 is less than or equal to TVREFL, it is determined that the NOx removing device 15 is normal, and the program proceeds to step S79. If TVO2 is greater than TVREFL in step S75A, the determination withholding flag FEXT67B is set to "1" (step S85).

After the flag FEXT67B is set to "1", the program proceeds from step S74 to step S84, in which it is determined whether or not the second exhaust amount parameter GAIRLNCH is greater than or equal to the predetermined determination threshold GAIRHOK. If GAIRLNCH is less than GAIRHOK, the program ends at once. If GAIRLNCH is greater than or equal to GAIRHOK, it is determined whether or not the downstream O2 sensor output TVO2 is less than or equal to the second downstream reference voltage TVREFH (step S83A). If TVO2 is less than or equal to TVREFH, it is determined that the NOx removing device 15 is normal, and the program proceeds to step S79. If TVO2 is greater than TVREFH, it is determined that the NOx removing device 15 is deteriorated (the degree of deterioration is an unusable level), and the program proceeds to step S81.

The process of FIG. 7 is summarized as follows:

1) If the downstream O2 sensor output TVO2 exceeds the first downstream reference voltage TVREFL at the time the first exhaust amount parameter GAIRLNCL has reached the NG determination threshold GAIRLNG, it is determined that the NOx removing device 15 is deteriorated (steps S80, S93, and S81).

2) If the downstream O2 sensor output TVO2 is less than or equal to the first downstream reference voltage TVREFL at the time the first exhaust amount parameter GAIRLNCL has reached the OK determination threshold GAIRLOK, it is determined that the NOx removing device 15 is normal (steps S77, S75A, and S79).

3) If the downstream O2 sensor output TVO2 exceeds the first downstream reference voltage TVREFL at the time the first exhaust amount parameter GAIRLNCL has reached the OK determination threshold GAIRLOK, the determination of whether the NOx removing device 15 is normal or deteriorated is withheld (steps S77, S75A, and S85), and the following determination is then performed.

3A) If the downstream O2 sensor output TVO2 is less than or equal to the second downstream reference voltage TVREFH at the time the second exhaust amount parameter GAIRLNCH has reached the predetermined determination threshold GAIRHOK, it is determined that the NOx removing device 15 is normal (steps S84, S83A, and S79).

3B) If the downstream O2 sensor output TVO2 exceeds the second downstream reference voltage TVREFH at the time the second exhaust amount parameter GAIRLNCH has reached the predetermined determination threshold GAIRHOK, it is determined that the NOx removing device 15 is deteriorated (steps S84, S83A, and S81).

Further, in the above-described embodiment, the proportional type air-fuel ratio sensor (oxygen concentration sensor) 17 is provided upstream of the three-way catalyst 14, and the binary type oxygen concentration sensors 18 and 19 are respectively provided upstream and downstream of the NOx removing device 15. The type and arrangement of each oxygen concentration sensor are not limited to the above embodiment. For example, all of the oxygen concentration sensors may be of either the proportional type or the binary type.

What is claimed is:

1. An exhaust emission control system for an internal combustion engine, having a catalyst provided in an exhaust system of said engine for purifying exhaust gases, and a NOx removing device provided downstream of said catalyst for absorbing NOx contained in the exhaust gases in an exhaust lean condition, said exhaust emission control system comprising:

a first oxygen concentration sensor provided between said catalyst and said NOx removing device for detecting the oxygen concentration in the exhaust gases;

a second oxygen concentration sensor provided downstream of said NOx removing device for detecting an oxygen concentration in the exhaust gases;

an air-fuel ratio switching module for switching the air-fuel ratio of the air-fuel mixture to be supplied to said engine from a lean region to a rich region with respect to a stoichiometric ratio;

a first measuring module for measuring a first time period of the elapsed time period of the time when the output from said first oxygen concentration sensor has reached a first reference value after switching the air-fuel ratio from the lean region to the rich region;

a second measuring module for measuring a second time period as an elapsed time period from the time the output from said first oxygen concentration sensor has reached a second reference value corresponding to a richer air-fuel ratio with respect to the first reference value; and a deterioration determining module for determining whether said NOx removing device is normal or deteriorated according to the first and second time periods and the output from said second oxygen concentration sensor.

2. An exhaust emission control system according to claim 1, wherein said deterioration determining module determines that said NOx removing device is normal if the first time period is greater than or equal to an OK determination threshold at the time the output from said second oxygen concentration sensor has reached the first reference value.

3. An exhaust emission control system according to claim 1, wherein said deterioration determining module determines that said NOx removing device is deteriorated if the first time period is less than an NG determination threshold at the time the output from said second oxygen concentration sensor has reached the first reference value.

4. An exhaust emission control system according to claim 1, wherein said deterioration determining module determines that said NOx removing device is normal if the first time period is greater than or equal to an NG determination threshold and less than an OK determination threshold, which is greater than the NG determination threshold at the time the output from said second oxygen concentration sensor has reached the first reference value, and if the second time period is greater than or equal to a predetermined determination threshold at the time the output from said second oxygen concentration sensor has reached the second reference value.

5. An exhaust emission control system according to claim 1, wherein said deterioration determining module determines that said NOx removing device is deteriorated if the first time period is greater than or equal to an NG determination threshold and less than an OK determination threshold, which is greater than the NG determination threshold at the time the output from said second oxygen concentration sensor has reached the first reference value, and if the second time period is less than a predetermined determination threshold at the time the output from said second oxygen concentration sensor has reached the second reference value.

6. An exhaust emission control system according to claim 1, wherein said deterioration determining module determines that said NOx removing device is deteriorated if the output from said second oxygen concentration sensor is greater than the first reference value at the time the first time period has reached an NG determination threshold.

7. An exhaust emission control system according to claim 1, wherein said deterioration determining module determines that said NOx removing device is normal if the output from said second oxygen concentration sensor is less than or equal to the first reference value at the time the first time period has reached an OK determination threshold.

8. An exhaust emission control system according to claim 1, wherein said deterioration determining module determines that said NOx removing device is normal if the output from said second oxygen concentration sensor is greater than the first reference value at the time the first time period has reached an OK determination threshold, and if the output from said second oxygen concentration sensor is less than or equal to the second reference value at the time the second time period has reached a predetermined determination threshold.

9. An exhaust emission control system according to claim 1, wherein said deterioration determining module determines that said NOx removing device is deteriorated if the output from said second oxygen concentration sensor is greater than the first reference value at the time the first time period has reached an OK determination threshold, and if the output from said second oxygen concentration sensor is greater than the second reference value at the time the second time period has reached a predetermined determination threshold.

10. An exhaust emission control system for an internal combustion engine, having a catalyst provided in an exhaust system of said engine for purifying exhaust gases, and a NOx removing device provided downstream of said catalyst for absorbing NOx contained in the exhaust gases in an exhaust lean condition, said exhaust emission control system comprising:

a first oxygen concentration sensor provided between said catalyst and said NOx removing device for detecting the oxygen concentration in the exhaust gases;

a second oxygen concentration sensor provided downstream of said NOx removing device for detecting the oxygen concentration in the exhaust gases;

an air-fuel ratio switching module for switching the air-fuel ratio of the air-fuel mixture to be supplied to said engine from a lean region to a rich region with respect to a stoichiometric ratio;

a first reducing-component amount calculating module for calculating a first reducing-component amount which is the amount of reducing components flowing into said NOx removing device from the time the output of said first oxygen concentration sensor has reached a first reference value after switching the air-fuel ratio from the lean region to the rich region;

a second reducing-component amount calculating module for calculating a second reducing-component amount which is the amount of reducing components flowing into said NOx removing device from the output of said first oxygen concentration sensor has reached a second reference value corresponding to a richer air-fuel ratio with respect to the first reference value; and a deterioration determining module for determining whether said NOx removing device is normal or deteriorated according to the first and second reducing-component amounts and the output from said second oxygen concentration sensor.

11. An exhaust emission control system according to claim 10, wherein said deterioration determining module determines that said NOx removing device is normal if the first reducing-component amount is greater than or equal to an OK determination threshold at the time the output from said second oxygen concentration sensor has reached the first reference value.

12. An exhaust emission control system according to claim 10, wherein said deterioration determining module determines that said NOx removing device is deteriorated if the first reducing-component amount is less than an NG determination threshold at the time the output from said second oxygen concentration sensor has reached the first reference value.

13. An exhaust emission control system according to claim 10, wherein said deterioration determining module determines that said NOx removing device is normal if the first reducing-component amount is greater than or equal to an NG determination threshold and less than an OK determination threshold, which is greater than the NG determination threshold at the time the output from said second oxygen concentration sensor has reached the first reference value, and if the second reducing-component amount is greater than or equal to a predetermined determination threshold at the time the output from said second oxygen concentration sensor has reached the second reference value.

14. An exhaust emission control system according to claim 10, wherein said deterioration determining module determines that said NOx removing device is deteriorated if the first reducing-component amount is greater than or equal to an NG determination threshold and less than an OK determination threshold, which is greater than the NG determination threshold at the time the output from said second oxygen concentration sensor has reached the first reference value, and if the second reducing-component amount is less than a predetermined determination threshold at the time the output from said second oxygen concentration sensor has reached the second reference value.

15. An exhaust emission control system according to claim 10, wherein said deterioration determining module determines that said NOx removing device is deteriorated if the output from said second oxygen concentration sensor is greater than the first reference value at the time the first reducing-component amount has reached an NG determination threshold.

16. An exhaust emission control system according to claim 10, wherein said deterioration determining module determines that said NOx removing device is normal if the output from said second oxygen concentration sensor is less than or equal to the first reference value at the time the first reducing-component amount has reached an OK determination threshold.

17. An exhaust emission control system according to claim 10, wherein said deterioration determining module determines that said NOx removing device is normal if the output from said second oxygen concentration sensor is greater than the first reference value at the time the first reducing-component amount has reached an OK determination threshold, and if the output from said second oxygen concentration sensor is less than or equal to the second reference value at the time the second reducing-component amount has reached a predetermined determination threshold.

18. An exhaust emission control system according to claim 10, wherein said deterioration determining module determines that said NOx removing device is deteriorated if the output from said second oxygen concentration sensor is greater than the first reference value at the time the first reducing-component amount has reached an OK determination threshold, and if the output from said second oxygen concentration sensor is greater than the second reference value at the time the second reducing-component amount has reached a predetermined determination threshold.

19. A computer readable medium storing program code for causing a computer to carry out a method for determining deterioration of a NOx removing device provided in an exhaust system of an internal combustion engine, said NOx removing device absorbing NOx contained in exhaust gases in an exhaust lean condition, said exhaust system being provided with a catalyst located upstream of said NOx removing device for purifying exhaust gases, a first oxygen concentration sensor located between said catalyst and said NOx removing device for detecting the oxygen concentration in the exhaust gases, and a second oxygen concentration sensor located downstream of said NOx removing device for detecting the oxygen concentration in the exhaust gases, said method comprising the steps of:

a) switching the air-fuel ratio of the air-fuel mixture to be supplied to said engine from a lean region to a rich region with respect to a stoichiometric ratio;

b) measuring a first time period of the elapsed time period of the time when the output from said first oxygen concentration sensor has reached a first reference value after switching the air-fuel ratio from the lean region to the rich region;

c) measuring a second time period of the elapsed time period of the time when the output from said first oxygen concentration sensor has reached a second reference value corresponding to a richer air-fuel ratio with respect to the first reference value; and d) determining whether said NOx removing device is normal or deteriorated according to the first and second time periods and the output from said second oxygen concentration sensor.

20. A computer readable medium storing program code for causing a computer to carry out a method for determining deterioration of a NOx removing device provided in an exhaust system of an internal combustion engine, said NOx removing device absorbing NOx contained in exhaust gases in an exhaust lean condition, said exhaust system being provided with a catalyst located upstream of said NOx removing device for purifying exhaust gases, a first oxygen concentration sensor located between said catalyst and said NOx removing device for detecting the oxygen concentration in the exhaust gases, and a second oxygen concentration sensor located downstream of said NOx removing device for detecting the oxygen concentration in the exhaust gases, said method comprising the steps of:

a) switching the air-fuel ratio of the air-fuel mixture to be supplied to said engine from a lean region to a rich region with respect to a stoichiometric ratio;

b) calculating a first reducing-component amount which is the amount of reducing components flowing into said NOx removing device from the time the output of said first oxygen concentration sensor has reached a first reference value after switching the air-fuel ratio from the lean region to the rich region;

c) calculating a second reducing-component amount which is the amount of reducing components flowing into said NOx removing device from the time the output of said first oxygen concentration sensor has reached a second reference value corresponding to a richer air-fuel ratio with respect to the first reference value; and d) determining whether said NOx removing device is normal or deteriorated according to the first and second reducing-component amounts and the output from said second oxygen concentration sensor.

* * * * *